US005809885A

United States Patent [19]

Koch et al.

[11] Patent Number: 5,809,885

[45] Date of Patent: Sep. 22, 1998

[54] BLOWER FOR PRINTING PRESSES FOR ASSISTING IN THE GUIDANCE OF SHEETS

[75] Inventors: Michael Koch, Cossebaude; Bernd Dietrich, Coswig; Andreas Leuschke, Coswig; Klaus Winkler, Coswig, all of Germany

[73] Assignee: Druckmaschinenwerk Planeta, Germany

[21] Appl. No.: 709,781

[22] Filed: Sep. 9, 1996

[51] Int. Cl.[6] ..... B41F 13/00

[52] U.S. Cl. ..... 101/232; 101/424.1; 271/195

[58] Field of Search ..... 101/232, 424.1; 271/195, 196, 276; 239/548, 550, 566, 367, 391

[56] References Cited

U.S. PATENT DOCUMENTS

| | | | |
|---|---|---|---|
| 4,395,949 | 8/1983 | Jeschke | 101/420 |
| 5,108,034 | 4/1992 | Huey et al. | 239/13 |
| 5,404,806 | 4/1995 | Proctor | 101/118 |
| 5,502,788 | 3/1996 | Platsch | 101/424.1 |
| 5,579,693 | 12/1996 | Carreira et al. | 101/424.1 |

*Primary Examiner*—Edgar S. Burr
*Assistant Examiner*—Dave A. Ghatt
*Attorney, Agent, or Firm*—Schweitzer Cornman Gross & Bondell LLP

[57] ABSTRACT

A blower for printing presses for assisting in the guidance of sheets, and being acted on by individual jets of compressed air, the blower comprising an outer air pressure tube having blowing apertures, the outer tube being connected to a source of air pressure, the air pressure tube having outer air pressure tube orifices therein for blowing toward the edges of the sheet, and an inner air pressure tube disposed entirely within the outer air pressure tube, the outer tube being provided with central portion orifices for blowing compressed air therethrough onto the central portion of the sheet, and optionally a plurality of valves for pneumatically acting on said inner of air pressure tube or on both said inner and said outer air pressure tubes.

6 Claims, 2 Drawing Sheets

BLOWER FOR PRINTING PRESSES FOR ASSISTING IN THE GUIDANCE OF SHEETS

FIELD OF THE INVENTION

The present invention relates to a blower for printing presses for assisting in the guidance of sheets.

BACKGROUND

It is customary in rotary sheet printing presses to provide blowers which extend over the width of the sheet-guidance path, the air pressure jet of which is directed against the sheets so that the printed sheets do not smear on parts of the machine. The sheet has to be smoothed out by the blower so that it does not crease and can be properly guided through the machine.

When working with a variety of different printing materials it is necessary to adjust the blower to the specific material being printed. Such a blower is known, for instance, from German Patent No. 2,603,483. Air pressure tubes are arranged along the path of the sheets in accordance with that patent, these tubes preventing a pick-off of the sheets or blurring in the vicinity of the cylinder. In this case, the air pressure tubes operate normally pneumatically. Synchronous control is not provided of the pressurized, blown air as a function of the format length of the sheet, or the speed of rotation of the machine. This arrangement has the disadvantage that the blowers can be operated only with a high consumption of energy. Air eddies are also produced in the printing press as a result of the pneumatic action on the air pressure tubes, due to the leakage air, and this results in rough passage of the printing sheet.

When working with stiff printing materials, such as a board, it has also been noted that the board being printed is blown under in the case of small maximum format width. As a result of this rough guidance of the printed material occurs through the printing press.

SUMMARY OF THE INVENTION

The object of the present invention is to provide a blower for printing presses which can easily be adapted for use with different printing materials and by the use of which underblowing of the side regions is avoided when thick printing materials are used.

In accordance with the invention, this object is achieved by a blower for printing presses for assisting in the guidance of sheets having a central portion and edges and being acted on by individual jets of compressed air, the blower having an outer air pressure tube with blowing apertures, the outer tube being connected to a source of air pressure, the outer air pressure tube having outer air pressure tube orifices therein for blowing toward the edges of the sheet, and an inner air pressure tube disposed entirely within the outer pressure tube, the outer tube being provided with central portion orifices for blowing compressed air therethrough onto the central portion of the sheet, and plurality of valves for cyclically pneumatically acting on the inner of air pressure tube or on both the inner and the outer air pressure tubes.

Compressed air supplied from an air compressor can be optionally used to assist in the guidance of the sheet supplied only to the inner air pressure tube when printing is done on sheets that are boards, and both to the inner and to the outer air pressure tubes when printing is done on paper sheets. The blower provides assurance that light printing materials which are being acted on over the entire width of the sheet by a stream of air of low air pressure (about 1 bar), as well as thick printing materials, such as boards which are acted on only in the region of the center of the sheet by a stream of air of higher air pressure (about 6 bar) are guided through the printing press free of creases and smearing.

Pneumatic support of the guidance of the sheet can be achieved in accordance with the present invention under the most different operating conditions which exist when working with a wide variety of sheets.

BRIEF DESCRIPTION OF THE DRAWING

The invention is further disclosed by reference being had to a suitable embodiment thereof shown in the accompanying drawing, wherein.

DETAILED DESCRIPTION

Figure 1:
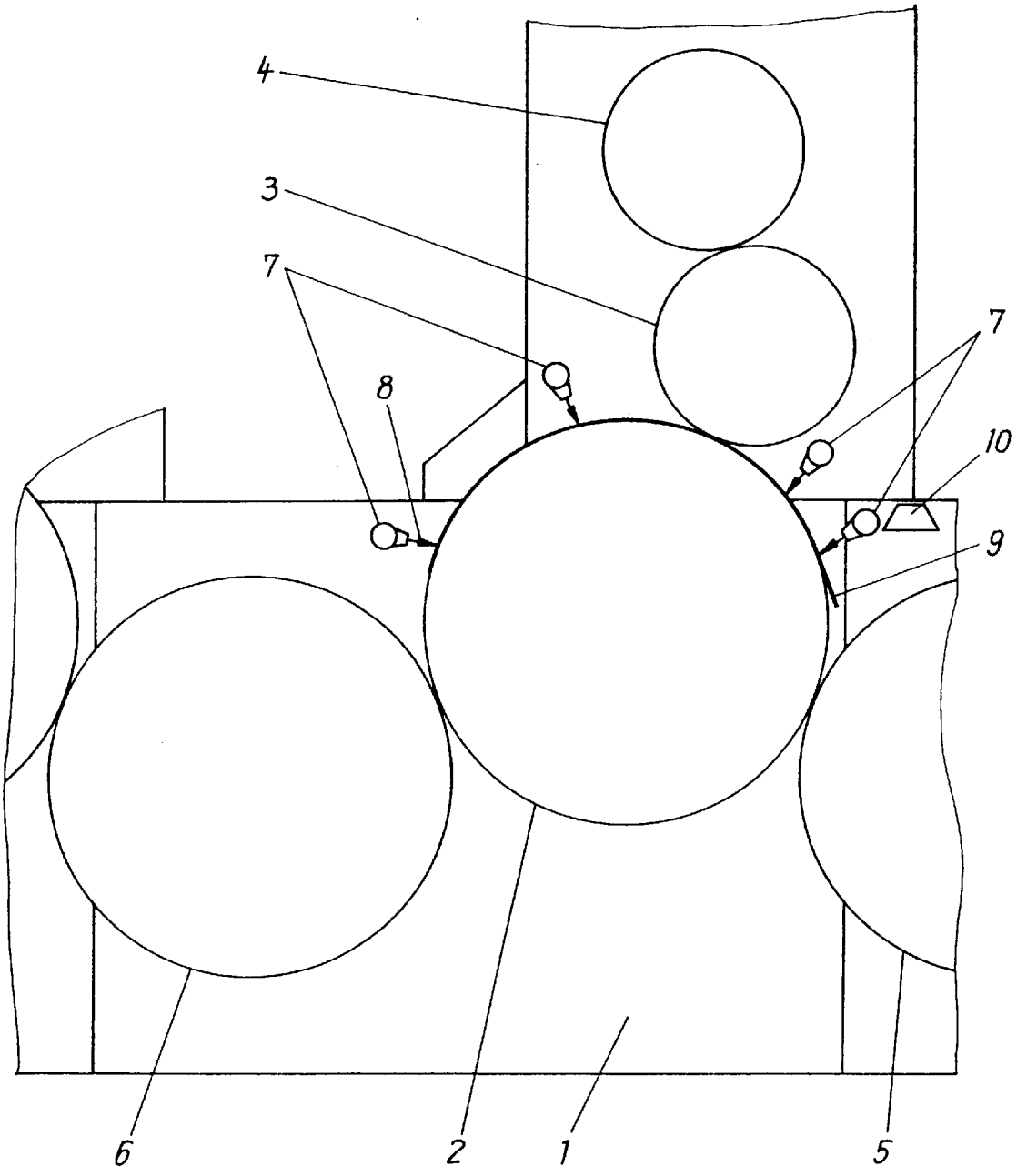
FIG. 1 shows a suitable embodiment of a printing mechanism of a printing press having the blower.

A printing mechanism 1 of a printing press, shown in FIG. 1, has an impression cylinder 2, a rubber blanketed cylinder 3, and a plate cylinder 4, as well as first and second transfer drums 5, 6. Blowers 7 of the present invention are arranged in the vicinity of the path of the sheet 9, with the stream of air 8 from the blowers being directed onto the sheet in the vicinity of the path along which it is guided. The blowers 7 are suitably arranged in the immediate vicinity of functionally required cross members 10, on which the sheets 9 tend to smear.

Figure 2:
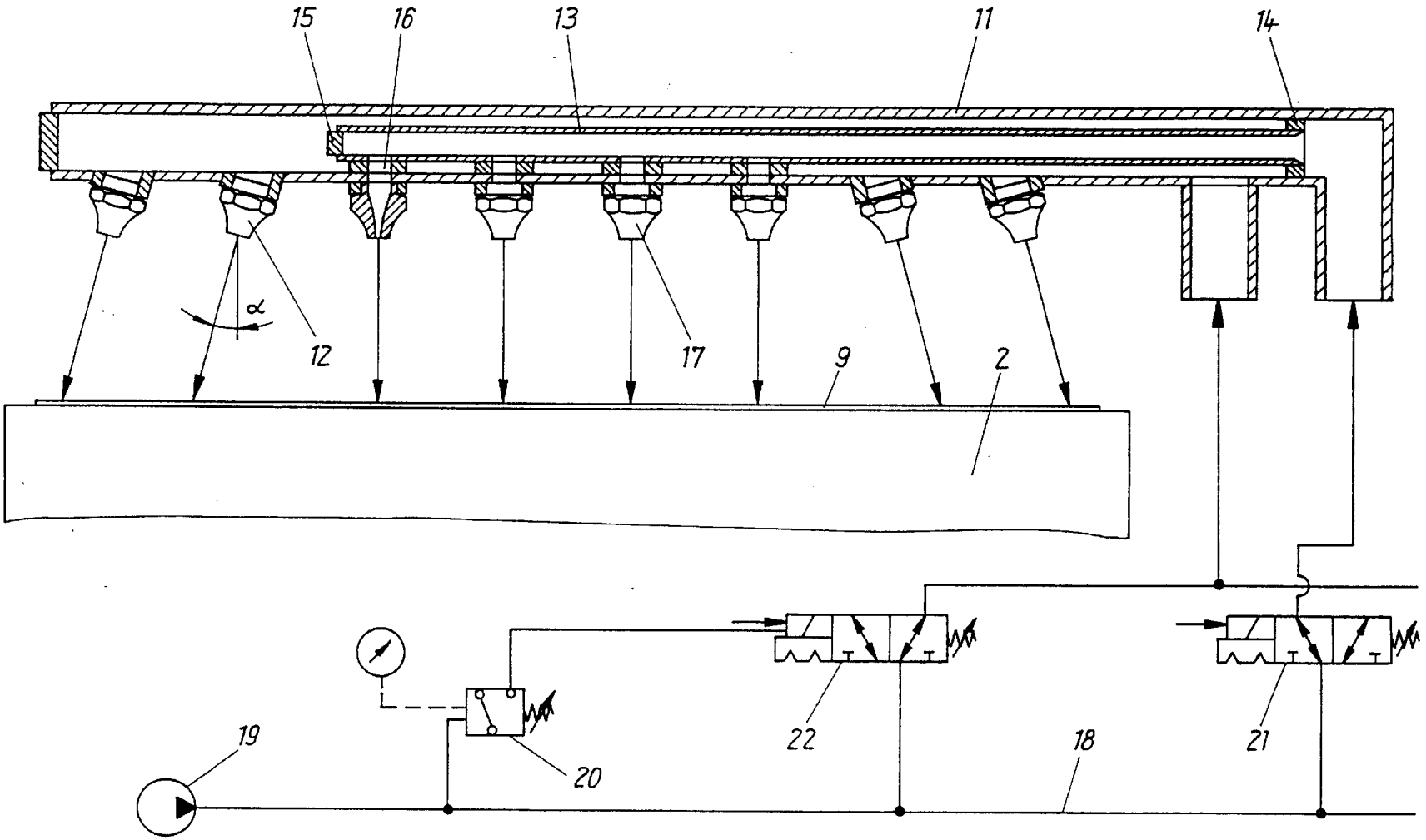
FIG. 2 shows in detail a blower with air feed.

A blower 7 (see FIG. 2) has an outer tube 11 which extends over the width of the air pressure impression cylinder 2 and is provided on its periphery with outer nozzles 12 the apertures of which are directed against the impression cylinder 2 in the vicinity of it periphery. It is possible, as shown, to arrange the outer nozzles 12 at an oblique angle $\alpha$. The angle $\alpha$ is suitably between 10° and 30°.

An inner air pressure tube 13 is disposed within the outer air pressure tube 11. The tube 13 has, at its outer end, a seal 14 which seals the tube 13 from the outer air pressure tube 11 and, a tube closure 15 at the other, the inner free end.

Orifices 16 are drilled in the wall of the inner air pressure tube 13 over the area of the minimal format size of the sheet 9, these orifices also passing through the outer air pressure tube 11 with nozzles 17 directed towards the sheet 9. The nozzles 17 receive the compressed air from the orifices 16.

The inner and outer air pressure tubes 11, 13 are each connected by a compressed air supply line 18 to a common source of air pressure, or compressor 19. A pressure-limiting valve 20 is arranged downstream of the compressor 19, behind which valve a timing valve 21 for supplying the inner air pressure tube 13 with air, and on-off valve 22 are provided for supplying the outer air pressure tube 11 with air, in the switch positions shown in FIG. 2.

In operation of the blower of the present invention the sheet 9 fed to the impression cylinder 2 by the first transfer drum 5 pneumatically acted on by the jet of compressed air 8 emerging from the blower 7. The sheet 9 is smoothed out by the jet 8 of compressed air, and is guided while resting smoothly on the impression cylinder 2 so that smearing at any point is prevented.

The blower 7 is adjusted when stiff printing materials are used.

The sheet 9 is acted on, regardless of its width, only in the central region of the impression cylinder 2. For this purpose, the desired air pressure (suitably at 6 bar) is set manually or from a control console, on the pressure-limiting valve 20, and the on-off valve 22 is closed. The air pressure tube 13 and thus the nozzles 17 are acted on cyclically by the timing valve 21, so that the board 9 is acted on in its central region by the jet 8 of compressed air synchronously with the sequence of boards 9.

The blower 7 is set for printing on paper sheets, or other light printing sheets, by adjusting the necessary air pressure on the pressure limiting valve 20 suitably to about 1 bar. The timing valve 21 is opened so that is does not carry out any timing, and the on-off valve 22 is also opened.

In this way, both the outer air pressure tube 11 and the inner air pressure tube 13 are continuously acted upon by compressed air. The jet 8 of compressed air thus emerges from the outer nozzles 12 at the outer regions of the higher sheet, as well as from the nozzles 17, and acts on the sheet 9 over its entire width.

We claim:

1. A blower for printing presses for assisting in the guidance of sheets having a central portion and edges, and being acted on by individual jets of compressed air, the blower comprising an outer air pressure tube having blowing apertures, the outer tube being connected to a source of air pressure, the outer air pressure tube having outer air pressure tube orifices therein for blowing toward the edges of the sheet, and an inner air pressure tube disposed entirely within said outer pressure tube, said outer tube being provided with central portion orifices for blowing compressed air therethrough onto the central portion of the sheet, and a plurality of valves for cyclically pneumatically acting on said inner of air pressure tube or on both said inner and said outer air pressure tubes.

2. The blower of claim 1, wherein said blowing apertures in said outer air pressure tube are arranged within said outer tube at an obliquely outward pointing angle.

3. The blower of claim 1, wherein said orifices in said inner air pressure tube are continued to orifices in said outer air pressure tube.

4. The blower of claim 1, wherein a timing valve is provided for said inner air pressure tube, and an on-off valve is provided for said outer air pressure tube.

5. The blower of claim 1, wherein the interior of said inner air pressure tube is hermetically sealed from said outer air pressure tube.

6. The blower of claim 2 wherein said angle is from about 10° to about 30°.

* * * * *